US009027643B2

(12) United States Patent
Beattie et al.

(10) Patent No.: US 9,027,643 B2
(45) Date of Patent: May 12, 2015

(54) METHOD OF REMOVING CUTTERS

(75) Inventors: Scott Beattie, Kuala Lumpur (MY); Eric Michael Twardowski, Spring, TX (US); Ming Zo Tan, Singapore (SG)

(73) Assignee: Weatherford Technology Holdings, LLC, Houston, TX (US)

( * ) Notice: Subject to any disclaimer, the term of this patent is extended or adjusted under 35 U.S.C. 154(b) by 810 days.

(21) Appl. No.: 12/997,331

(22) PCT Filed: Jun. 11, 2009

(86) PCT No.: PCT/US2009/047123

§ 371 (c)(1), (2), (4) Date: Mar. 28, 2011

(87) PCT Pub. No.: WO2009/152391

PCT Pub. Date: Dec. 17, 2009

(65) Prior Publication Data

US 2011/0180261 A1 Jul. 28, 2011

Related U.S. Application Data

(60) Provisional application No. 61/060,670, filed on Jun. 11, 2008.

(51) Int. Cl.

| | |
|---|---|
| ***E21B 44/00*** | (2006.01) |
| ***E21B 3/03*** | (2006.01) |
| ***E21B 12/02*** | (2006.01) |
| ***E21B 17/14*** | (2006.01) |

(52) U.S. Cl.
CPC ..... *E21B 17/14* (2013.01)

(58) Field of Classification Search
CPC ..... E21B 3/03; E21B 10/43; E21B 12/02; E21B 44/00
USPC ..... 175/57, 402, 426
See application file for complete search history.

(56) References Cited

U.S. PATENT DOCUMENTS

| | | | | |
|---|---|---|---|---|
| 3,913,686 | A * | 10/1975 | Manson, Jr. | 175/39 |
| 5,425,288 | A * | 6/1995 | Evans | 76/108.2 |
| 6,151,960 | A | 11/2000 | Taylor et al. | |
| 7,096,982 | B2 | 8/2006 | McKay et al. | |
| 7,204,324 | B2 * | 4/2007 | Gleitman et al. | 175/57 |

(Continued)

OTHER PUBLICATIONS

PCT Written Opinion and Search Report for International Application No. PCT/US2009/047123 dated Feb. 7, 2011.

(Continued)

*Primary Examiner* — Catherine Loikith
(74) *Attorney, Agent, or Firm* — Patterson & Sheridan, L.L.P.

(57) ABSTRACT

A method for enhanced degradation of a cutting structure on a drill shoe is provided. The cutting structure may be degraded at an accelerated rate after achieving a desired objective. Degradation of the cutting structures on the drill shoe may facilitate the eventual drill out of the drill shoe. In one embodiment, a method of degrading the cutting structure includes operating the drill shoe using a reduced flow rate of drilling fluid. In another embodiment, a method of degrading the cutting structure includes operating the drill shoe at an increased rotary speed. In yet another embodiment, a method of degrading the cutting structure includes operating the drill shoe with an increased weight on bit. In yet another embodiment, a method of degrading the cutting structure includes any combination of one or more of the enhanced degradation methods described herein.

20 Claims, 4 Drawing Sheets

(56) References Cited

U.S. PATENT DOCUMENTS

| | | | | |
|---|---|---|---|---|
| 7,395,882 | B2 * | 7/2008 | Oldham et al. | 175/402 |
| 7,404,457 | B2 | 7/2008 | Xu et al. | |
| 7,407,020 | B2 * | 8/2008 | Gleitman et al. | 175/57 |
| 7,464,771 | B2 | 12/2008 | Lynde | |
| 7,484,571 | B2 | 2/2009 | Gaudette et al. | |
| 7,565,928 | B2 | 7/2009 | Lynde et al. | |
| 2005/0183892 | A1 | 8/2005 | Oldham et al. | |

OTHER PUBLICATIONS

PCT Written Opinion and Search Report for International Application No. PCT/US2009/047123 dated Mar. 9, 2011.

Chengdu BEST Diamond Bit Co., Ltd., Best bit, http://www.bestdiamondbit.com/en/exhibit2/exhview.asp?pid=14, dated Jan. 29, 2008, 2 Pages.

* cited by examiner

METHOD OF REMOVING CUTTERS

CROSS-REFERENCE TO RELATED APPLICATIONS

This application claims benefit of co-pending U.S. Provisional Patent Application Serial No. 61/060,670, filed on Jun. 11, 2008, which application is herein incorporated by reference in its entirety.

BACKGROUND OF THE INVENTION

1. Field of the Invention

Embodiments of the present invention relate generally to drilling of a wellbore and, more particularly, to drilling of a wellbore using casing as a drilling string. More particularly still, embodiments of the present invention relate generally to removal of a drilling structure at the end of a casing.

2. Description of the Related Art

The drilling of wells to recover hydrocarbons from subsurface formations is typically accomplished by directing a rotatable drilling element, such as a drill bit, into the earth on the end of tubing known as a "drill string" through which drilling mud is directed to cool and clean the drilling face of the drill bit and remove drilled material or cuttings from the wellbore as it is drilled. A typical well may have wellbore sections having different sizes. After a section of wellbore has been drilled or bored to its desired depth and location, the wellbore is typically cased, i.e., metal tubing is located along the length of the wellbore and cemented in place to isolate the wellbore from the surrounding earth, to prevent the formation from caving into the wellbore, and to isolate the earth formations from one another. After that, the next smaller size wellbore will be drilled to a deeper depth and then cased. The last casing is then perforated at specific locations where hydrocarbons are expected to be found, to enable their recovery through the wellbore.

It is known to use casing as the drill string, and, when drilling is completed to a desired depth, to cement the casing in place and thereby eliminate the need to remove the drill string from the wellbore. Thereafter, a subsequent drill string is used to drill through the prior drill string and extend the wellbore further into the earth.

However, because the prior drill string is not removed, equipment such as the drill bit, also referred to as the drill shoe, in the prior drill string may present drill out issues to the subsequent drill string. Thus, the drill shoe of the prior drill string should be eliminated as an obstacle, without pulling the prior drill string from the wellbore.

One method used to facilitate removal of the drill shoe is to manufacture the drill shoe using a drillable material. Use of drillable material, however, limits the loading that can be placed on the drill shoe during drilling, which may reduce the efficiency of drilling with the drillable drill shoe. A typical "drillable" drill shoe configuration includes a relatively soft metal, such as aluminum, with relatively hard inserts of materials such as synthetic diamond located thereon to serve as the cutting material. The hard cutters of the drill shoe also pose a concern because the hard cutters may increase wear and physical damage to the subsequent drill shoe or drill bit being used to drill through the previous drill shoe, thereby reducing the life of the subsequent drill bit and the depth of formation it can penetrate before it no longer drills effectively.

There is a need, therefore, for a method of removing the cutting structure on a casing drill string to reduce the potential for damage to the drill out tool. There is also a need for a method to remove the cutting structure on a drill shoe located at the end of a casing after the drill shoe has reached a target depth.

SUMMARY OF THE INVENTION

Embodiments of the present invention provide a method of removing a cutting structure on a drilling member attached to a casing or suitable wellbore tubulars. Under typical drilling conditions, the cutting structure may wear down at a normal rate as the wellbore is extended. In this respect, the drilling member may be configured with sufficiently robust cutting structures to ensure that a desired objective is achieved under normal drilling operations. Thereafter, the cutting structure may be intentionally degraded at an accelerated rate. Degradation of the cutting structure may facilitate a subsequent drill out process.

In one embodiment, the enhanced degradation of the cutting structures may be initiated after a desired target depth is reached. In another embodiment, the enhanced degradation of the cutting structure may be initiated after a desired geological formation is reached. In yet another embodiment, the enhanced degradation of the cutting structure may be initiated after the drill shoe has been operated for a predetermined time period. In yet another embodiment, the enhanced degradation of the cutting structure may be initiated after problems in the wellbore prevent the wellbore to be drilled further. In yet another embodiment, the enhanced degradation of the cutting structure may be initiated after a predetermined petrophysical parameter has been logged by logging while drilling. In yet another embodiment, the enhanced degradation of the cutting structure may be initiated after a predetermined deviation of the wellbore has been achieved. It is contemplated that enhanced degradation may be initiated after one or more of the objectives have been met.

In another embodiment, steps may be taken to preserve the integrity of the cutting structure until the desired objective is achieved. Thereafter, the cutting structure is deliberately degraded at an accelerated rate. In one embodiment, the steps to preserve the integrity of the cutting structure may include adjusting the drilling parameters such as flow rate of the drilling fluid; the rotary speed of the drill shoe; and the weight on bit of the drill shoe to maintain the drilling effectiveness of the cutting structure.

In another embodiment, a method of degrading a cutting structure on a drilling member includes operating the drilling member until a desired objective is achieved and then controlling operation of the drilling member to accelerate the degradation of the cutting structure.

In another embodiment, a method of degrading a cutting structure on a drilling member includes operating the drilling member until a desired objective is achieved and then continue operating the drilling member using a reduced drilling fluid flow rate through the drill member, thereby accelerating degradation of the cutting structure. In yet another embodiment, the method further includes increasing a rotary speed of the drilling member. In yet another embodiment, the method further includes increasing a weight on bit of the drilling member. In yet another embodiment, a method of degrading the cutting structure includes any combination of one or more of the degradation methods described herein.

In yet another embodiment, a method of degrading a cutting structure on a drilling member includes urging the drilling member to a target depth and then altering a drilling parameter while urging the drilling member past target depth to elevate a temperature of the cutting structure, thereby accelerating degradation of the cutting structure.

In yet another embodiment, a method of degrading a cutting structure on a drilling member includes operating the drilling member until a desired objective is achieved; maintaining integrity of the cutting structure while drilling; and then controlling operation of the drilling member to accelerate the degradation of the cutting structure after the desired objective has been achieved.

Current drill shoe designs involve a balance between drillability and durability. Embodiments of the present invention allow drill shoe designs to be more robust, and therefore, drill further without being detrimental to subsequent drill out operations.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
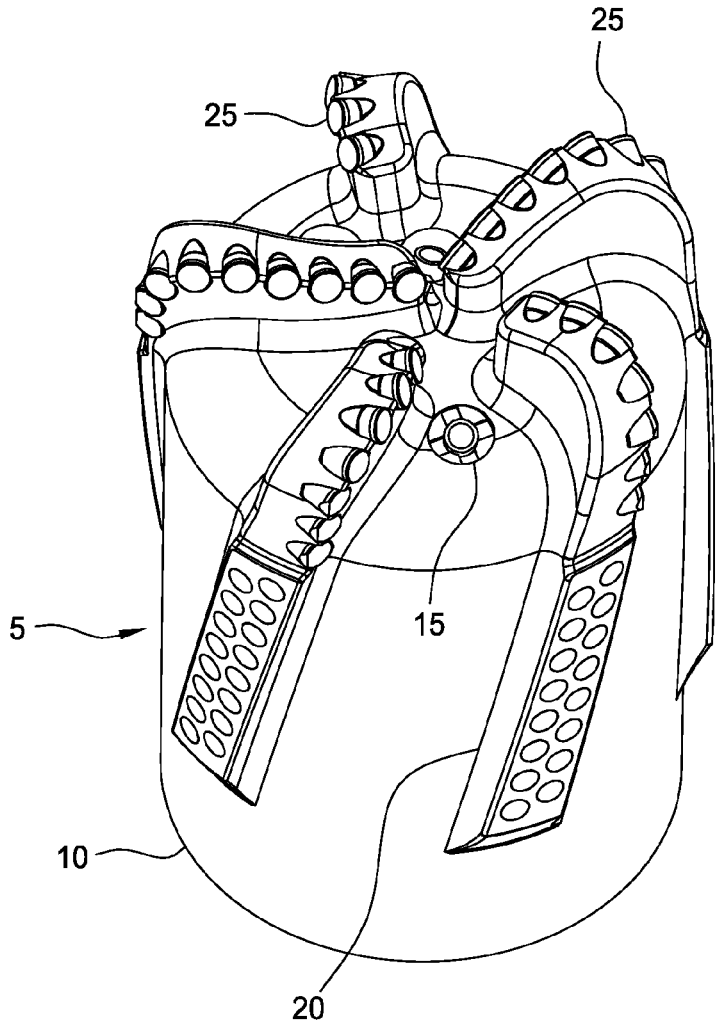
FIGS. 1A-1C show an exemplary drill shoe before initiation of a cutting structure degradation process in accordance with embodiments of the present invention.

Embodiments of the present invention provide a method of removing a cutting structure on a drilling member attached to a casing or other suitable types of wellbore tubulars. Under normal drilling conditions, the cutting structure may experience degradation as the wellbore is extended. In this respect, the drilling member is generally configured with sufficient robust cutting structures to ensure that the drilling operation will reach a desired objective. Additionally, efforts are made to minimize the rate at which the cutting structures are being degraded. The cutting structure remaining may pose a concern for the subsequent drill out. In one embodiment of the present invention, after reaching a desired objective, the cutting structure may be intentionally degraded at an accelerated rate by altering the drilling parameters. Degradation of the cutting structure may facilitate a subsequent drill out process.

The design of a drill shoe generally involves a balance between two competing design criteria. The first is to design the shoe with a durable cutting structure that will provide sufficient wear-resistance to enable the tool to reach a predetermined target depth at an acceptable rate of penetration. This same cutting structure must also be drillable by a subsequent drill-out tool, such as a bit, mill, or another drill shoe. The optimal design is a drill shoe that has sufficient durability to drill to a desired depth, but the durability should not be so great as to unduly hinder the drill-out procedure.

Nevertheless, ensuring that the drill shoe is capable of drilling to target depth is of utmost importance. Therefore, the design should provide at least sufficient cutting structure content for reaching target depth, even if the design requires a somewhat more difficult subsequent drill out.

There are many variables which affect the durability, also referred to as wear rates, of cutting structures. These variables include formation type, bit hydraulics, cutter layout, surface speed, weight on bit, impact loading, torque, and others. This multitude of variables increases the complexity of predicting the amount or content of wear-resistant material (e.g., PDC and tungsten carbide) in a drill shoe that is required for the particular application.

Embodiments of the present invention provide methods of reducing the amount of cutting structures remaining on the drill shoe after reaching target depth. When drilling out a drill shoe, the drill-out tool removes material in its path as it traverses the interior of the drill shoe. Embodiments of the present invention purposefully reduce the amount of cutting structures that lies in the path of the drill-out tool before attempting drill-out. Reduction of the cutting structures decreases the potential for damage to the drill-out tool and enables the drill-out tool to continue drilling past the drill shoe. Also, the reduction prior to drill-out of the drill shoe may provide for substantial time and cost savings during the drill-out process.

Embodiments of the present invention may be applicable to enhance degradation of any suitable cutting structures on a drilling member. Exemplary cutting structures may be categorized as super hard, ultra hard, and wear resistant materials. Common cutting structures include polycrystalline diamond compact ("PDC") and carbides such as tungsten carbide.

Methods for reducing the amount of cutting structure material such as PDC cutters on the drill shoe are described herein. After reaching a pre-determined target depth, and preferably prior to drill-out, the remaining PDC inserts on the drill shoe may be worn down or destroyed by taking advantage one or more of the herein mentioned thermally or mechanically accelerated wear characteristics of PDC. In one embodiment, a method of degrading the cutting structure includes operating the drill shoe using a reduced flow rate of drilling fluid. In another embodiment, a method of degrading the cutting structure includes operating the drill shoe at an increased rotary speed. In yet another embodiment, a method of degrading the cutting structure includes operating the drill shoe with an increased weight on bit. In yet another embodiment, a method of degrading the cutting structure includes any combination of one or more of the degradation methods described herein. For example, a combination of increasing the weight on bit and rotary speed, while reducing or even eliminating the flow of drilling fluid may cause the PDC inserts to reach elevated temperatures. The elevated temperatures may cause the PDC inserts to wear at an accelerated rate.

While not wishing to be bound by theory, it is believed that cutting structures such as PDC cutters degrade at elevated temperatures. PDC cutters are extremely wear-resistant materials having a diamond table which is metallurgically bonded to a tungsten carbide substrate in a high-pressure/high-temperature ("HPHT") process. A PDC cutter typically includes diamond and Cobalt within the diamond table. As temperature is increased, the Cobalt will thermally expand to a greater extent than the network of diamond crystals. When the temperature gets high enough, the forces exerted by the expanding Cobalt will break the diamond crystals apart. This process is called graphitization. For example, when a conventional PDC cutter reaches an elevated temperature of approximately 725° C., graphitization of the polycrystalline diamond will occur. In must be noted that temperatures lower or higher than 725° C. may also be applicable to degrade the cutting structures. In an example of a smaller increase in temperature, for example, to about 600° C., the operation may be sustained for a longer period of time to achieve a satisfactory degradation of the cutting structure.

Figure 1C:
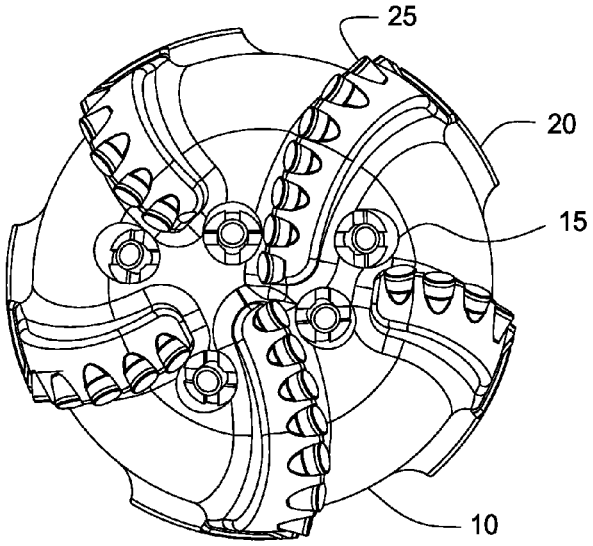
Figure 1B:
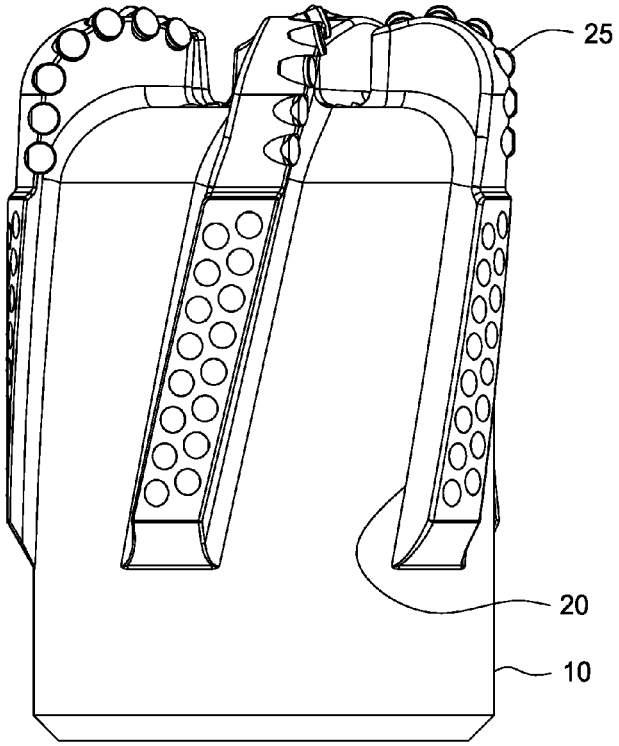

FIGS. 1A-1C show an exemplary drill shoe suitable for use with a casing in a drilling with casing application. In FIG. 1, the drill shoe 5 is shown in an unworn condition. The drill shoe 5 may include a body 10, at least one nozzle 15, a plurality of blades 20, and a plurality of cutting structures 25. The blades 20 may be positioned around the circumference of the body 10 and include any suitable number of blades, such as four, five, or six. One portion of the blade 20 may be disposed on the sidewall of the body 10 and another portion may be disposed on the end of the body 10. The blades 20 are raised with respect to the body 10 such that the blades 20 would encounter the formation before the body 10. In one embodiment, the body 10 may be manufactured from a drillable material such as aluminum, and the cutting structures 25 may be made from PDC. In one embodiment, the cutting structures 25 are disposed on the blades for contacting the formation. As shown, the cutting structures 25 are disposed along the edges of the blades 20. The amount of cutting structures 25 and/or the number of blades 20 positioned on the drill shoe 5 may change depending on the particular application. In this respect, the drill shoe 5 may be configured with sufficient cutting structures 25 to ensure the desired target depth is reached or other objectives are achieved.

Embodiments of the present invention provide methods to elevate the temperature of the cutting structure or between the cutting structure and the formation to degrade or remove the cutting structures on the drill shoe. In one embodiment, the flow rate of the drilling fluid is reduced or eliminated to cause inadequate cooling at the drill shoe. The reduction in flow rate causes the temperature of the cutting structure to rise, thereby enhancing degradation of the cutting structure. In one example, the flow rate of the drilling fluid is reduced by at least 50% of the flow rate used to drill the wellbore. Preferably, the flow rate is reduced by about 70%, and more preferably, by about 85%. In another example, the flow rate is reduced to a level sufficient to provide a minimum annular velocity to remove debris from the wellbore such that rotation of the drill shoe is not hindered. In an exemplary application, a 17" casing drilling system may be used to drill a wellbore while supplying about 1,000 gpm of drilling fluid to facilitate the drilling operation. After reaching target depth, the flow rate of the drilling fluid may be reduced to about 400-500 gpm; preferably, about 200-300 gpm; and more preferably, about 100-150 gpm. The reduction in flow rate is sufficient to cause an increase in temperature of the cutting structures, thereby degrading the cutting structures over time.

Figure 2A:
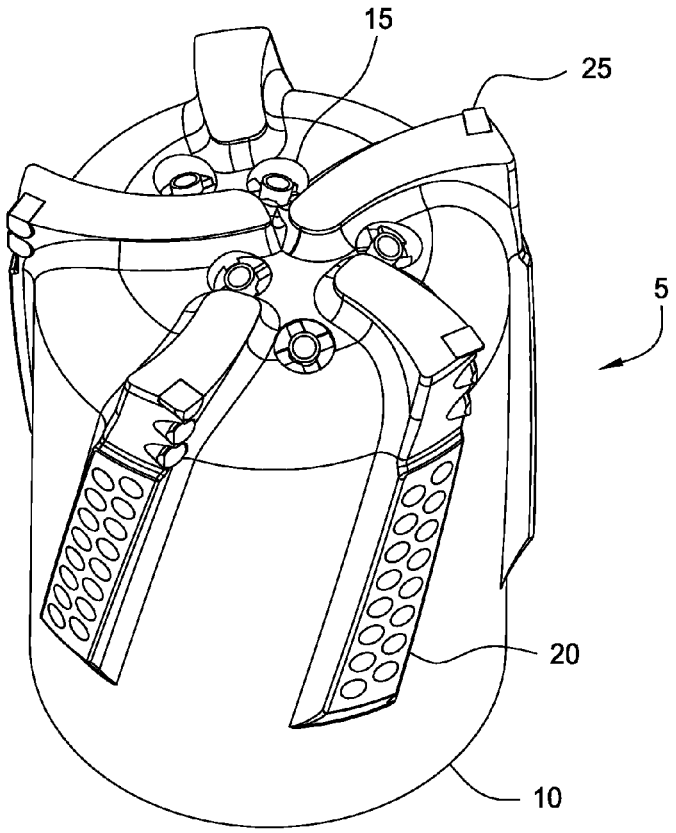
FIGS. 2A-2C illustrate an exemplary "worn out" drill shoe after the degradation process.
Figure 2C:
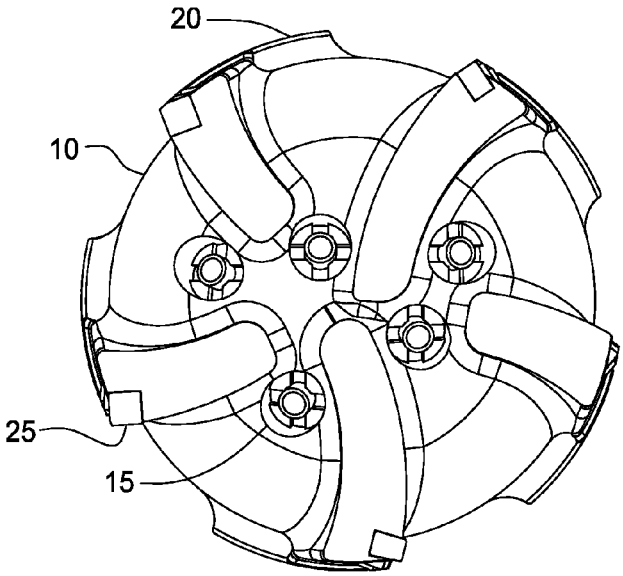
Figure 2B:
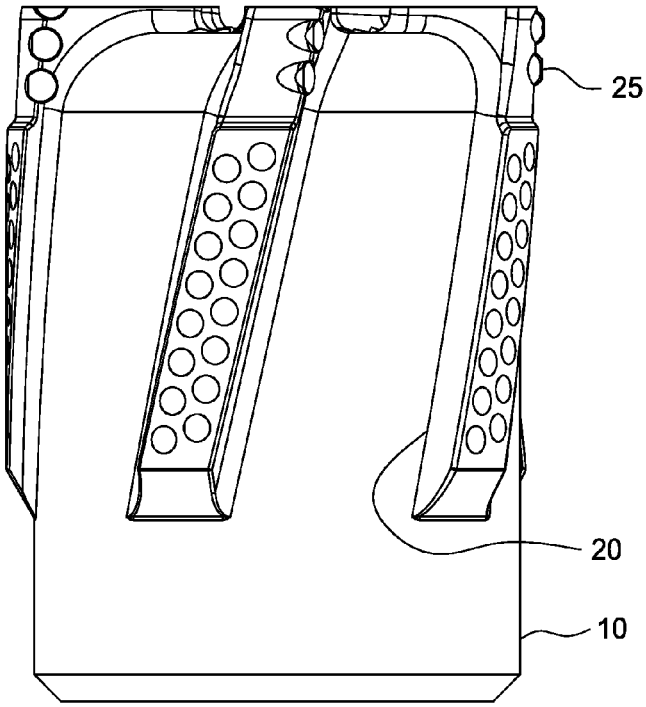

FIGS. 2A-2C illustrate an exemplary "worn out" drill shoe 5. It can be seen that the cutting structures 25 in the central region of the drill shoe 5 have been removed. Additionally, a substantial portion of the blades 20 has also been removed. The removal of the cutting structures 25 and the blades 20 create a "wear flat" area. The wear flat area increases over time as more cutting structures 25 are removed. The wear flat area increases the contact area between the cutting structures 25 such as PDC inserts and the formation. This increased contact area creates even more friction and additional heat generation at the drill shoe. Additionally, the heat generated in the center of the wear flat area is further from the PDC face and more difficult to dissipate. The accumulated heat can result in heat checking and cracking within the diamond table and tungsten carbide substrate, thereby increasing the rate of degradation of the cutting structure.

In another embodiment, the temperature of the cutting structure may be elevated by increasing the rotary speed of the drill shoe. The increase in rotary speed may create more friction between the cutting structure and the formation, thereby generating more heat to elevate the temperature. In one example, the rotary speed is increased to about the maximum speed of the casing drive system or at least 85% of the maximum speed. In another example, the rotary speed may be increased to the maximum speed tolerable by the connection joints, such as the torque limits of the connection joints. In yet another example, the rotary speed may be increased to the predetermined speed limit set for the drilling operation. In yet another example, the rotary speed is increased to at least 25% more than the rotary speed during drilling, and preferably, at least 35% of the rotary speed during drilling. For example, if the rotary speed during drilling is about 110 rpm, the rotary speed may be increased to more than about 140 rpm, preferably, more than 150 rpm, to elevate temperature of the drill shoe.

In yet another embodiment, the cutting structure may be degraded by applying additional weight on bit. The additional weight on bit may increase the frictional force of the cutting structure with the formation, thereby increasing the temperature of the cutting structure. In one example, the additional amount of weight applied is at least 20% more than the weight on bit applied during the drilling operation, preferably, at least 25% of the weight on bit applied during drilling. The additional weight on bit may be increased to the maximum tolerable weight on bit for the drill shoe, preferably, to at least 85% of maximum tolerable weight on bit.

In another embodiment, the cutting structure may be degraded by urging the cutting structure in an abrasive formation. Exemplary abrasive formations include sandstone, volcanic rocks, dolomite, chert, and other abrasive formations known to a person of ordinary skill in the art. Contact of the cutting structure with the abrasive formation increases the friction between the cutting structure and the abrasive formation, thereby degrading the cutting structures.

The process of enhanced degrading of the cutting structures may be initiated after a desired objective has been achieved. In one embodiment, the process of reducing the wear resistant material may begin after the desired target depth is reached. In this respect, the design of the drill shoe may be sufficiently robust so as to ensure target depth is reached. Thereafter, the cutting structures may be degraded or destroyed using one or more of the degradation process described herein. For example, any combination of eliminating or reducing the flow rate of the drilling fluid, increasing rotary speed, and/or increasing weight on bit may be applied to increase the wear rate of the cutting structures. By purposefully and significantly "wearing away" the cutting structures on the drill shoe, the effort required to drill-out the drill shoe is significantly reduced. In another embodiment, the drill string may be operated to drill to a desired target geological formation before the process of destroying the cutting structures is initiated. For example, the drill string may be operated until the drill shoe reaches an abrasive formation. In yet another embodiment, the drill string may be operated for a predetermined time before the intentional destruction of the cutting structures is initiated.

In yet another embodiment, the enhance degradation of the cutting structures may be initiated after a predetermined petrophysical parameter, pattern, or trace have been observed, for example, by logging while drilling techniques. For example, the degradation may begin after a predetermined resistivity, porosity, indigenous wellbore fluid characteristics, and any combinations of these and other suitable parameters known to a person of ordinary skill have been logged. In yet another embodiment, the degradation of the cutting structure may be initiated after a predetermined deviation of the wellbore has been achieved. For example, the degradation may begin after a 15 degree deviation or any suitable deviation has been achieved.

In yet another embodiment, steps may be taken to preserve the integrity of the cutting structure until the desired objective is achieved. Thereafter, the cutting structure is deliberately degraded. In one embodiment, the steps to preserve the integrity of the cutting structure so that it may continue to drill effectively may include adjusting the drilling parameters such as flow rate of the drilling fluid and the rotary speed of the drill shoe.

In another embodiment, the drilling parameters may be tailored to purposefully degrade the drill shoe in anticipation of the drill shoe being at least partially destroyed upon reaching the desired objective. This controlled destruction of the drill shoe during drilling may be achieved using one or more of the enhanced degradation methods described herein. For example, during drilling, the flow rate of the drilling fluid may be gradually decreased in order to gradually increase the temperature of the cutting structure. Upon reaching the desired target depth, the flow rate is reduced dramatically, for example, by about 85%, to increase the friction at cutting structure contact surface, thereby increasing the rate of wear of cutting structure.

In another embodiment, the drilling parameters may be altered to accelerate degradation of the cutting structure after observing a triggering event. The triggering event may occur prior to reaching a desired objective. In one embodiment, the triggering event may include observing that a desired objective is well within reach, thus the process of accelerating the degradation of the cutting structure may be initiated. For example, the target objective may involve drilling a 30 degree deviated wellbore after 5,000 feet. At 4,000 feet, it is observed that the 28 degrees of deviation has been achieved. This observed event may trigger the initiation of enhanced degradation of the cutting structure.

Another mechanism for destroying PDC cutters is impact damage. The tool could be "spudded" by lifting off from the bottom of the well and then applying weight on bit in order to impart impact loads to the cutting structure. This mechanism may be used independently or in combination with one or more of the degradation process described herein.

In another embodiment, thermal shock may be applied to degrade cutting structures such as PDC cutters. Initially, heat at the cutting structure may be generated as described herein, for example, by reducing fluid flow rate through the drill shoe. Thereafter, the flow rate of the drilling fluid is significantly increased to cool the cutting structure, thereby thermally shocking the cutters. Thermal shocking the cutting structures may increase the potential for fracturing of the cutting structures. This mechanism may be used independently or in combination with one or more of the degradation process described herein.

In another embodiment, increased heat generation can weaken or even melt the braze joints which attach the PDC cutting structure to the blades. Weakened or melted braze joints increase the likelihood that the cutting structures may "dislodge" from the blades on the drill shoe. The dislodged cutters may be removed by fluid circulation from the hole bottom. In this respect, it is no longer necessary to mechanically drill through the cutters.

Embodiments of the present invention may be used to enhance degradation of the cutting structure of a drill shoe to facilitate the drill out of the drill shoe. In one embodiment, the exemplary drill shoe shown in FIG. 1 is used in a casing drilling application. The drill shoe 5 is configured with sufficient cutting structures to ensure the desired target depth is reached. During drilling, the drill shoe 5 is rotated at a speed of about 110 rpm. Drilling fluid is supplied at a flow rate of about 1,000 gpm through the drill shoe. When the target depth is reached, a process for accelerating degradation of the cutting structures 25 on the drill shoe 5 is initiated to reduce the amount of cutting structures 25 in the path of the drill out tool. In one embodiment, the flow rate of the drilling fluid is decreased by about 85% and the rotary speed increased by about 35%. Optionally, the weight on bit may be increased by about 25% more than the weight on bit applied during the drilling operation. In another embodiment, the target depth is located in an abrasive formation such as sandstone. The drill shoe 5 is operated under these heat generating conditions until the cutting structures 25 are worn. One way to determine the cutting structures 25 are worn is by monitoring the penetration rate during operation. When the depth is no longer increasing, it is an indication that the cutting structures 25 have been degraded or substantially destroyed. Another indication of a worn cutting structure is a reduction in torque. After one or both of these indicators are observed, fluid is circulated to remove debris in the wellbore. Cement is then supplied to cement the casing in the wellbore. Thereafter, a drill out tool may be inserted to drill through the drill shoe and extend the wellbore. FIG. 2 illustrates an exemplary "worn out" drill shoe. It can be seen that the cutting structures 25 in the central region of the drill shoe 5 have been removed. Additionally, a substantial portion of the blades 20 has also been removed.

While the foregoing is directed to embodiments of the present invention, other and further embodiments of the invention may be devised without departing from the basic scope thereof, and the scope thereof is determined by the claims that follow.

What is claimed is:

1. A method of degrading a cutting structure on a drilling member, comprising:

operating the drilling member until a desired objective is achieved, wherein during operation of the drilling member, the drilling member is operated at a first rotary speed;

upon reaching the desired objective, continue operating the drilling member at a second rotary speed that is faster than the first rotary speed, thereby accelerating degradation of the cutting structure;

monitoring an indicator to determine whether the drilling member is degraded; and after observing the indicator, drilling through a portion of the drilling member using a drill out tool.

2. The method of claim 1, further comprising increasing a weight on bit of the drilling member.

3. The method of claim 1, wherein the desired objective is reaching a target depth.

4. The method of claim 1, wherein the desired objective is one of reaching a target geological formation, operating the drilling member for a predetermined time period, and combinations thereof.

5. The method of claim 1, wherein the drilling member comprises a bit attached to a casing.

6. The method of claim 5, further comprising circulating a fluid to remove debris.

7. The method of claim 6, further comprising cementing the casing.

8. The method of claim 1, wherein the cutting structure comprises a PDC structure.

9. The method of claim 1, wherein the second rotary speed is at least twenty five percent faster than the first rotary speed.

10. The method of claim 1, wherein the indicator comprises at least one of reduction in penetration rate and reduction in torque.

11. A method of degrading a cutting structure on a drilling member, comprising:

urging the drilling member to a target depth wherein urging the drilling member comprises rotating the drilling member at a first rotary speed;

altering a drilling parameter to elevate a temperature of the cutting structure while urging the drilling member past the target depth, thereby accelerating degradation of the cutting structure, wherein altering the drilling parameter comprises rotating the drilling member at a second rotary speed that is faster than the first rotary speed and reducing a flow rate of a drilling fluid through the drilling member;

monitoring an indicator to determine whether the drilling member is degraded; and after observing the indicator, drilling through a portion of the drilling member using a drill out tool.

12. The method of claim 11, wherein altering the drilling parameter further comprises increasing a weight on bit of the drilling member.

13. The method of claim 11, wherein altering the drilling parameter further comprises increasing the flow rate of the drilling fluid after initially reducing the flow rate to thermally shock the cutting structure.

14. The method of claim 13, further comprising imparting an impact load on the cutting structure.

15. The method of claim 11, further comprising imparting an impact load on the cutting structure.

16. The method of claim 11, wherein the target depth is within an abrasive formation.

17. The method of claim 11, wherein the indicator comprises at least one of reduction in penetration rate and reduction in torque.

18. A method of degrading a cutting structure on a drilling member, comprising:

operating the drilling member until a desired objective is achieved;

maintaining integrity of the cutting structure while drilling, wherein maintaining integrity of the cutting structure comprises operating the drilling member at a first rotary speed; and then controlling operation of the drilling member to accelerate the degradation of the cutting structure after the desired objective has been achieved, wherein controlling operation of the drilling member to accelerate the degradation of the cutting structure comprises:

operating the drilling member at a second rotary speed that is faster than the first rotary speed;

using a reduced drilling fluid flow rate through the drilling member;

monitoring an indicator to determine whether the drilling member is degraded; and after observing the indicator, drilling through a portion of the drilling member using a drill out tool.

19. The method of claim 18, further comprising increasing a weight on bit of the drilling member.

20. The method of claim 18, wherein the indicator comprises at least one of reduction in penetration rate and reduction in torque.

* * * * *